United States Patent [19]

Lee

[11] Patent Number: 4,888,827

[45] Date of Patent: Dec. 26, 1989

[54] SHIRT AND TIE GARMENT PROTECTOR

[76] Inventor: Roger H. Lee, 1366 E. Sigfrid St., Eagan, Minn. 55123

[21] Appl. No.: 288,628

[22] Filed: Dec. 22, 1988

[51] Int. Cl.[4] ..... A41D 27/12

[52] U.S. Cl. ..... 2/52; 2/46

[58] Field of Search ..... 2/46, 48, 49 R, 49 A, 2/50, 51, 52, 156, 16, 59

[56] References Cited

U.S. PATENT DOCUMENTS

| | | | |
|---|---|---|---|
| 2,423,581 | 7/1947 | Clark | 2/49 |
| 2,747,192 | 5/1956 | Katz | 2/46 |
| 3,085,247 | 4/1963 | Bixby | 2/46 |
| 3,678,138 | 11/1971 | Retzkin | 2/46 |
| 3,714,669 | 2/1973 | Vorbau | 2/46 |
| 3,763,496 | 10/1973 | Miller | 2/46 |
| 3,833,937 | 9/1974 | Taylor | 2/46 |
| 3,879,763 | 4/1975 | Smith | 2/59 |
| 4,453,273 | 6/1984 | Gerrick | 2/46 |
| 4,716,595 | 1/1988 | Camphous | 2/46 |

FOREIGN PATENT DOCUMENTS

| | | | |
|---|---|---|---|
| 545404 | 10/1922 | France | 2/59 |
| 404651 | 1/1934 | United Kingdom | 2/59 |

*Primary Examiner*—Werner H. Schroeder
*Assistant Examiner*—Jeanette E. Chapman
*Attorney, Agent, or Firm*—Donald A. Jacobson

[57] ABSTRACT

A garment protector using an elongate tube formed of thin flexible plastic creased on opposite sides to provide a flat body and having a V-shaped extension on one end of the tube between the creases and a V-shaped indentation on the opposite end. The V-shaped indentation provides two pointed extensions which are used to hold the protector in place by placing them under a shirt collar. Anti-static material in the plastic prevents the sides from clinging to each other.

2 Claims, 2 Drawing Sheets

20
24
18
26
22
10

16
16
18
10
12
14

SHIRT AND TIE GARMENT PROTECTOR

FIELD OF THE INVENTION

This invention relates to the field of devices for attachment to a shirt for protection of the shirt and tie garment combination or a shirt alone.

BACKGROUND OF THE INVENTION

A number of previous inventions have addressed the problem of providing protection for only a tie.

In Camphous U.S. Pat. No. 4,716,595; the use of a pair of elongated flat sheet members having a shape substantially corresponding to the shape of a necktie bonded along a lateral side into which a necktie can be inserted with a pressure sensitive adhesive to hold the protector in place is taught.

In Gerrick U.S. Pat. No. 4,453,273 a necktie protector comprising a flat flexible plastic envelope having two identical elongate flat plastic faces joined at the long edges and not joined at the short edges with flat plastic tabs extending centrally from two adjacent unjoined edges to hold the protector in place is taught. These tabs provide a precarious purchase under the tie knot and relies on the pressure exerted by the knot to achieve even this purchase. The relatively narrow width of the tabs versus the width of the tie protector is essentially a poor design approach for the attachment means and fails completely if no tie is present.

In Taylor U.S. Pat. No. 3,833,937 an attachable protective napkin is used made of laminated absorbent and waterproof paper or plastic sheeting with a triangular shaped end which is sized to tuck about the tie and under the collar to hold the napkin in place.

In Miller U.S. Pat. No. 3,763,496 a neck-tie bar which clips onto a necktie with a roller having a flexible screen which can be unrolled to cover a necktie during eating or drinking is taught.

In Vorbau U.S. Pat. No. 3,714,669 a tie shield shaped in the general outline of a tie and knot uses a pressure-sensitive adhesive on the back to attach the shield to a wearer's collar.

In Retzkin U.S. Pat. No. 3,678,138 a tie bib which has convergent sides and generally resembles the shape of a sides and generally resembles the shape of a four-in-hand tie is constituted of a front panel with rearward folding flaps which form a sheath when they are folded back against the tie by means of the front panel. The force exerted by the folded flaps and the convergent edges of both the bib and the tie, keeps the two in proper relative position with respect to each other.

In Bixby U.S. Pat. No. 3,085,247 a combined tie clip and necktie protector is taught. The protector is wrapped about a roller and has an upper and a lower portion which are deployed from the roller. The upper portion has a hook which grips the knot of the tie while the lower end is held downward by a binding bar.

In Katz U.S. Pat. No. 2,747,192 a neck-tie protector uses a thin sheet of flexible plastic and having the general shape of the front lower portion of a necktie below the knot with a lower portion forming a pocket to hold the tie. The protector is secured by a bendable member which is long enough to be bent around the knot of the tie.

In Clark U.S. Pat. No. 2,423,581 a bib formed of a long single sheet of material having folds about a long dimension to partially enclose a tie and a bend about a short side which engages a strip which extends outwardly to permit the end being hooked around the knot of a necktie or over a collar to secure the bib in place is taught.

SUMMARY OF THE INVENTION

My device for protecting a shirt and tie together or a shirt alone utilizes an enclosing flexible plastic tube which is creased on opposite edges shaped at the lower end to generally match a tie end with the upper end having opposed X-shaped extension joints to hold the device in place under a shirt collar. This is effective whether a tie is worn or not and whether the shirt is buttoned or not. The width and length of the protector provides considerable protection for a shirt front and is useful even if no tie is worn. The use of extension points to hold the device in place provides a great deal of holding power with the minimum of complexity.

DESCRIPTION OF THE PREFERRED EMBODIMENT

Figure 3:
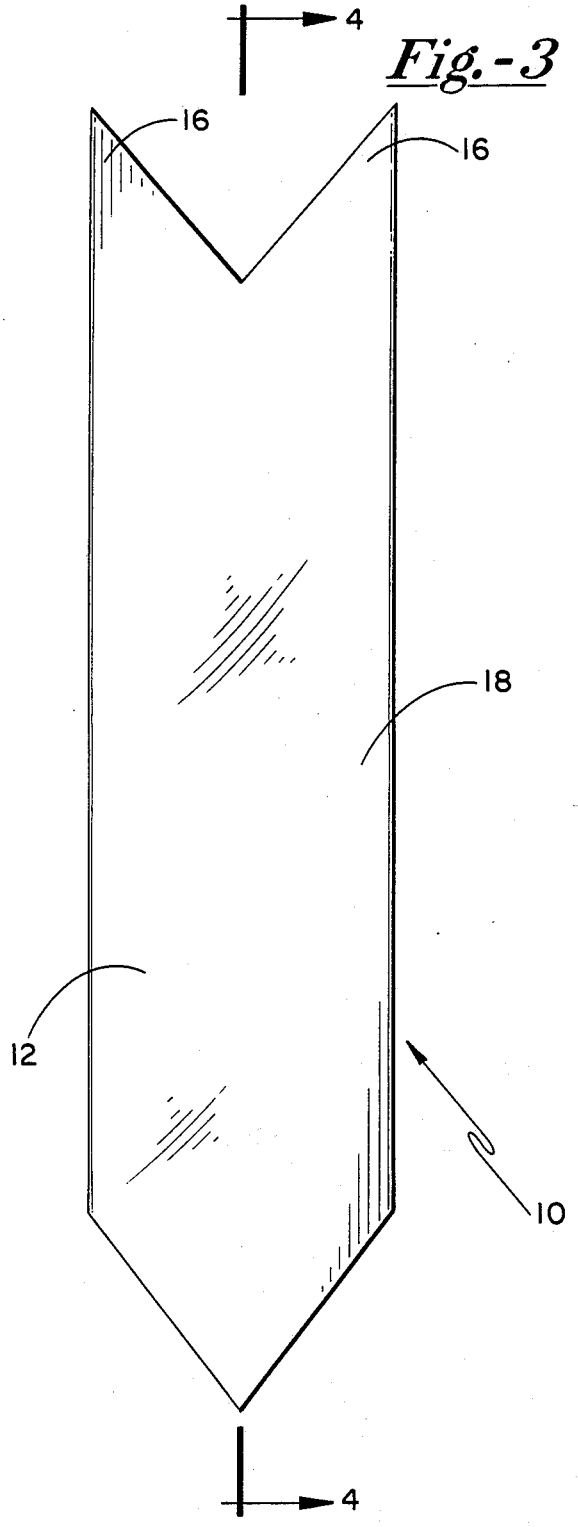
FIG. 3 is a front view of the protector.
Figure 4:
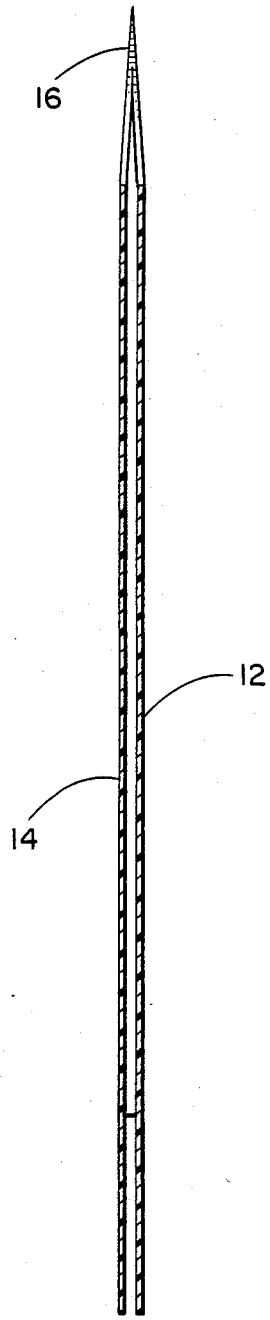
FIG. 4 is a cross-section view taken across 4—4 in FIG. 3.

In FIG. 3 the front view of the shirt and tie protector 10 is shown. The preferred length of protector 10 is 26 inches with a width of six inches. The angles between the edges forming a V shape at the top and bottom is approximately 50 degrees. Polyethelene plastic with a thickness of approximately 0.001 inches with an anti-static additive to reduce static cling is preferred. In FIG. 4 the two identical sides 12 and 14 respectively can be seen. The anti-static additive prevents these two sides from clinging to one another.

Referring again to FIG. 3 the two points 16 can be seen. These points 16 provide an attachment means whether or not a tie is worn to provide shirt protection in either case. The uses and installation will be discussed further later.

Figure 2:
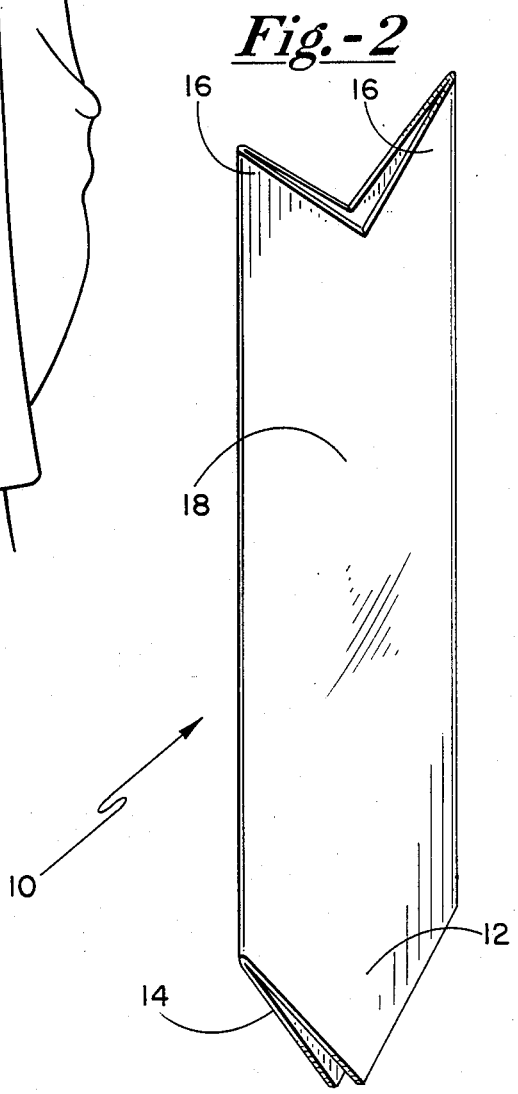
FIG. 2 is a perspective view of the protector.

In FIG. 2 a view of tie protector 10 deployed for attachment is shown. Since an anti-static additive has been used in the plastic material the two sides of body 18 separate to permit readily inserting a tie between the two sides 12 and 14 of body 18 and between the points 16 into protector 10. Since protector 10 is sized to receive any tie, even including extra wide ties, the protector is also wide enough to provide protection to the center of the shirt front even when a tie is not worn.

Figure 1:
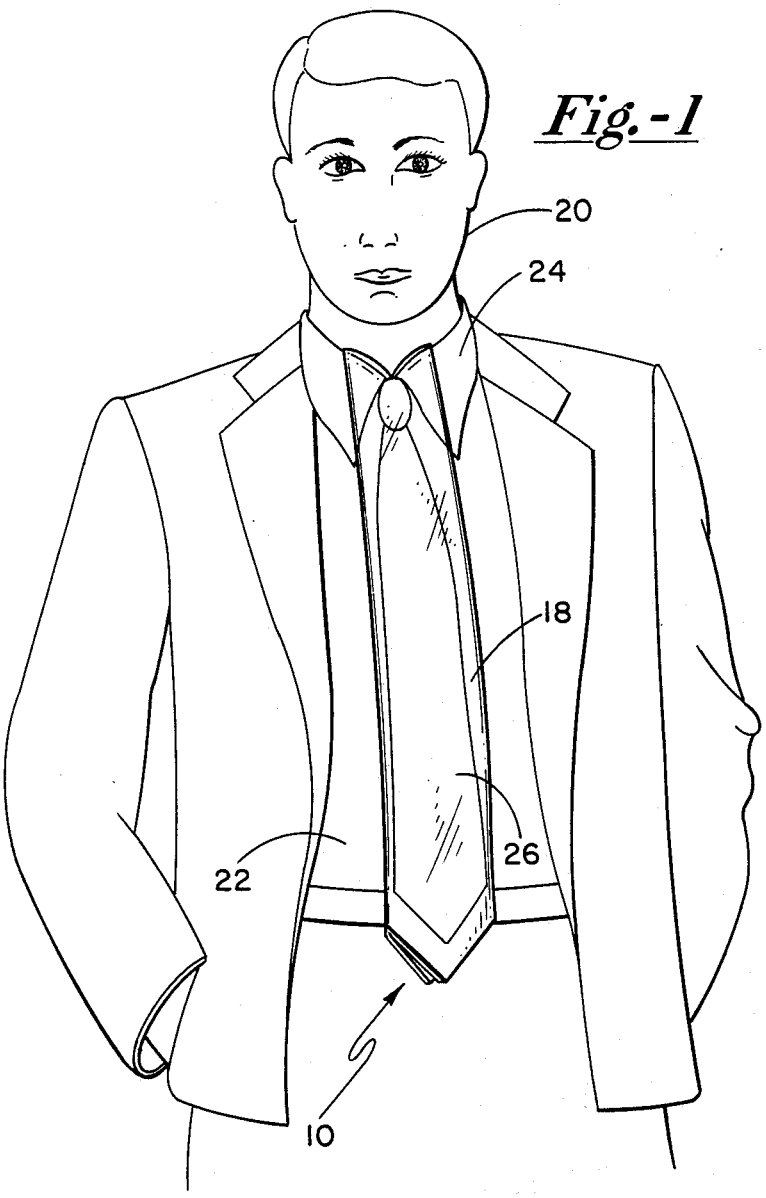
FIG. 1 is a front view of a user with the protector in place.

In FIG. 1 protector 10 is shown in use by a wearer 20 and covering the center front of a shirt 22 and enclosing a tie 26. Points 16, which do not show in this figure, are folded back under a collar 24 and hold protector 10 in place. This method of attachment does not require the use of a tie to assist in holding protector 10 in place which because of the generous dimensions mentioned earlier provides protection to the shirt front of a diner even when tie 26 is no being worn.

This method of attachment is simple yet effective and, if desired, can also be used with an unbuttoned sport shirt and will still provide the necessary holding force required to keep the protector in place.

The form selected for protector 10 provides protection for the front of a diner whether a tie is worn or not.

Further, extended points 16 will hold protector 10 in place whether a tie 26 is worn or not and whether the shirt collar 24 is buttoned or not to provide a universal protection which functions under all these conditions.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. A garment protector consisting of an elongate tube formed of flexible waterproof material, having opposed creases forming opposed edges in the elongate tube, and having identical front and back body portions between the edges, and having a first end edge of the elongate tube shaped to extend inwardly in a symmetric V shape with indentation from the opposed creased edges thereof.

2. A protector as in claim 1 wherein the flexible waterproof material contains anti-static means such that electrostatic charges will not cause the front and back body portions to adhere to one another.

* * * * *